US005538764A

United States Patent [19]

Li et al.

[11] Patent Number: 5,538,764

[45] Date of Patent: Jul. 23, 1996

[54] METHOD OF TREATING A SURFACE

[75] Inventors: Lin Li, Liverpool; Peter J. Modern, Preston; William M. Steen, Caldy, all of United Kingdom

[73] Assignee: British Nuclear Fuels plc, Warrington, United Kingdom

[21] Appl. No.: 335,357

[22] Filed: Nov. 3, 1994

[30] Foreign Application Priority Data

Nov. 5, 1993 [GB] United Kingdom ..... 9322845

[51] Int. Cl.[6] ..... B05D 3/00

[52] U.S. Cl. ..... 427/554; 427/140; 427/289; 427/344; 427/385.5; 427/397.7; 427/403; 427/407.1; 427/419.1; 427/427; 427/444; 427/596

[58] Field of Search ..... 427/554, 596, 427/140, 137, 289, 344, 385.5, 397.7, 403, 407.1, 427, 444

[56] References Cited

FOREIGN PATENT DOCUMENTS

| | | |
|---|---|---|
| 0091646 | 10/1983 | European Pat. Off. . |
| 3500750A1 | 7/1986 | Germany . |
| 93/13531 | 7/1993 | WIPO . |

OTHER PUBLICATIONS

Derwent Abstract No. AX-91-049031/07, relating to JP 3002595. (no date available).

Derwent Abstract No. 92-157483/19, relating to JP-4099999. (no date available).

S. J. Lee et al., "Shock Wave Analysis of Laser Assisted Particle Removal," J. Appl. Phys., vol. 74, No. 12, Dec. 15, 1993, pp. 7044-7047.

D. J. Flesher, "Lasers and High-Energy Light as a Decontamination Tool for Nuclear Application," Westinghouse Hanford Co., Dec. 1993.

N. S. Cannon et al, "Lasers for the Radioactive Decontamination of Concrete," Westinghouse Hanford Co., Oct. 1993.

*Primary Examiner*—Bernard Pianalto

*Attorney, Agent, or Firm*—Oliff & Berridge

[57] ABSTRACT

A method of treating a concrete or other non-metallic surface contaminated with embedded radionuclides to reduce the total level of radioactivity in a concrete or other hydraulically bonded material body is described. The method comprises the steps of producing relative mutual movement between the surface to be removed and a laser heat source such that a layer adjacent the surface is caused to be detached from said concrete body. The surface may be detached as a vapour, in flakes or as a sheet.

23 Claims, 1 Drawing Sheet

METHOD OF TREATING A SURFACE

The present invention relates to a method of treating a non-metallic surface, particularly a contaminated surface having embedded contaminants in the surface layer or layers, and more particularly, though not exclusively, a surface contaminated with radionuclides.

In the nuclear industry surfaces of objects such as mechanical components and constructional features become contaminated with radionuclides. Common contaminants include uranium oxide, plutonium oxide, strontium-90, caesium-137 and cobalt-60. These contaminants may be present in the form of fine particulates or originate from solutions containing them. Where such contaminants are deposited on concrete structures, the porous nature of concrete means that the contaminants may be present up to a considerable depth. However, the principal proportion of the contaminants, about 90%, are situated within a few millimetres of the surface. Hence, the safe removal of the surface layer or layers can greatly reduce the degree of radioactive contamination present.

Various techniques have been proposed for the decontamination of surfaces. However, due to the embedded nature of the contaminants, the prior art techniques of chemical washing, fluid shear blowing and paste/stripping have not been entirely successful. Furthermore, these prior art methods have the disadvantage of producing secondary waste problems due to mixing of the additional materials with the removed contamination and most importantly, they only remove surface contaminants, not contaminants embedded below the surface.

JP 3002595 describes the removal of a concrete surface layer by crushing due to the heat generated by the use of microwaves to irradiate the contaminated surface layer.

DE 3500750 describes inductively heating steel reinforcing bars within a structure to cause the removal of contaminated concrete therefrom.

In our co-pending patent application number PCT/GB90/02404, we describe the use of an intense heat source passed across a contaminated surface to fix or seal the radioactive contaminants therein.

In all of these prior art treatments the radioactive contaminants remain in large pieces of material which require disposal in large pieces, or which require further processing, or the contamination is sealed into the structure body, thus not decreasing the total level of radioactivity of the body or structure in question. One of the principal problems of the prior art methods described is that they produce large pieces of concrete which have a very high proportion of relatively uncontaminated material associated with the contaminated material. Thus, unnecessarily large volumes of material require disposal or further processing.

It is an object of the present invention to provide a method for the removal of embedded contamination adjacent a surface layer or layers from a porous substrate such that the removed layer may be safely collected and disposed of, such that the total level of contaminants in the substrate or body in question is reduced.

According to the present invention there is provided a method for the removal of a contaminated surface layer or layers from a concrete or other hydraulically bonded material body, the method comprising the steps of producing relative mutual movement between the surface to be removed and a laser heat source such that a layer adjacent the surface is caused to be detached from said body.

According to a first aspect of the method of the present invention, the surface is removed by vaporisation thereof.

Desirably, the fume generated by vaporisation of the concrete surface is collected by suitable extraction equipment such that it does not further contaminate the surrounding area.

The minimum power density to achieve vaporisation of concrete is advantageously about 5000 W/cm$^2$. However, power densities down to 2500 W/cm$^2$ have been successfully employed with appropriate control of traverse speed. It has been found that a concrete removal rate of about 100 to 300 cm$^3$/hr.kW may be achieved and a depth of removal of about 10 μm/J.

The vaporisation technique can remove up to a few millimetres depth at one pass depending upon available power. Due to the poor thermal conductivity of concrete, surface evaporation may be achieved with little substrate heating.

Typical operating parameters for a carbon dioxide laser are a traversing speed of between about 30 to 200 mm/s at power levels of about 400 to 1500 W CW laser beam having a spot size of between about 3 to 6 mm.

Other types of laser may be used including YAG lasers which have the advantage of being transmittable through optical fibres.

It has been found that some underlying glazing of the residual surface may occur which is advantageous in sealing at least a part of the remaining contamination into the body. Paints or plastics resin materials such as epoxy resins coated onto a concrete surface may be efficiently removed by this first aspect of the method of the present invention.

Multiple passes may be employed so as to produce further glazing of the treated surface. As the degree of glazing increases, the rate of evaporation from the surface decreases due to the glazing effect. This has the added advantage of sealing in any residual contamination even more effectively into the substrate or body. The subsequent passes may be under the same or different conditions to those used for evaporation.

According to a second aspect of the method of the present invention, the contaminated surface may be caused to be detached from the body by the generation of thermal stresses below the surface causing fracture of the concrete and flaking off of a surface layer. The body surface may be treated with a laser heat source to heat the concrete but such that melting of the concrete surface does not occur. Concrete starts to dehydrate at about 200° C. The thermal stress together with the moisture and air expansion which is created below the surface causes the surface layer to flake off with the entrapped contaminants.

It has been found that the concrete surface flakes off during traversing of the laser, the flakes being ejected from the surface with significant force and velocity. The ejected flakes may be trapped and collected by suitable means for safe disposal.

A required range of power density of a laser lies in the range from about 100 W/cm$^2$ to about 800 W/cm$^2$. A preferred range may be about 300 W/cm$^2$ to about 800 W/cm$^2$. Typical values of traversing speed may lie in the range from about 30 mm/min to about 300 mm/min. The traversing speed cannot be too high in order that sufficient time is allowed for heat build-up below the surface. Similarly, the power density should not be so high that significant melting or vaporisation of the surface occurs. The traversing speed is partly dependent on the moisture content of the concrete. Where the moisture content is relatively high, the traverse speed may also be relatively high as the vapour pressure generated will assist in the removal of the surface flakes. The traverse speed will also be influenced by the chemical composition and physical constitution of the concrete. These factors also affect the power density required, a high concrete moisture content necessitating a lower power density laser, for example. The traverse speed and the power density are interrelated and, to some extent, may be used to compensate each other, ie a lower power density being compensated by a lower traverse speed, for example.

It has been found that concrete removal depths of about 1 mm to about 4 mm may be achieved in one pass. It has also been found that the volume rate of concrete removal is high at between about 500 to about 800 $cm^3$/hr. kW.

Multiple passes may be made to achieve greater depth removal.

The rate of removal may be assisted by soaking the concrete with water prior to laser treatment so as to increase the vapour pressure within the concrete.

The resulting concrete surface is rough but clean without signs of the heating effect of the laser. An advantage of the second aspect of the method of the present invention is the high efficiency of surface removal in that heating to the melting point of the concrete is not required. A further important advantage over the prior art is that only that material having a relatively high level of contamination may be removed if desired. However, the actual depth of removal may be selected and achieved by multiple passes. Therefore, accurate control of the depth and degree of contamination removal is possible.

According to a third aspect of the method of the present invention, the contaminated surface layer may be caused to be detached from the body by heating with a laser heat source to produce a heat affected zone (HAZ) in the body below the surface thereof, at least a part of the HAZ having been subjected to a temperature range of between about 550° C. and about 900° C.

Breakdown of the hydrated chemical bond in ordinary Portland cement (OPC) based concrete begins to occur at about 550° C. and the compressive strength of OPC concrete is weakest at about 800° C. to 900° C. Melting of a layer of surface material by a laser will produce a HAZ below the surface during heating and during subsequent cooling down of the melted surface layer. The melting point of concrete lies in the range from about 1600° to about 1750° C., and therefore, the HAZ will have a region which has been heated within the range from about 550° C. to about 900° C.

It has been found that after a laser beam has been traversed across the surface area of a contaminated concrete body, the laser beam causing glazing of the surface, that the surface layer becomes detached by fracture through the HAZ.

By control of the power density and the traverse speed, the depth of the HAZ may be controlled and hence the thickness of the layer which becomes detached may also be controlled.

Preferably, a relatively thin first coating of cementitious or refractory material is applied to the contaminated surface before laser treatment. Preferably, the thickness of the applied layer is less than 1 mm but, this is not critical and can be thicker.

The applied first coating may comprise a mixture of chamotte, pozzolanna, water glass and cement. The coating may be applied as a sprayed coating. The purpose of this coating is inter alia to seal in any surface contamination and to tie-down airborne contamination.

Subsequent laser treatment may cause the applied first coating and the surface of the concrete substrate to be glazed, thus sealing in the contaminants adjacent the surface. The generation of the underlying HAZ causes the concrete to shear through the HAZ and cause the surface layer of the concrete body and the glazed first coating adhered thereto to become detached from the concrete substrate.

Preferably, a layer of a second coating material is applied to the laser treated surface. The second coating material may comprise a wide variety of materials and may include, for example, water glass, cement, mixtures including cement, or plastics resins such as epoxy resin.

The layer of the second coating material provides a two-fold advantage in that it seals in any surface contamination which may have been generated and redeposited during the laser glazing step and also provides mechanical strength by binding the detached surface layer together as a continuous sheet.

The detached surface layer may be cut by laser means into conveniently sized sections which may then be lifted off by suitable means. Suitable means may include mechanical gripping devices or vacuum gripping means, for example.

Minimum laser power density for the third aspect of the method according to the present invention is about 150 W/$cm^2$. Maximum power density is that short of the point where significant evaporation of the surface begins to occur for the given traversing conditions. Again, factors such as power density and traverse speed are interrelated and variations will affect the depth of the HAZ.

This third aspect of the present invention has the particular advantage that all the contaminants are bound together in a solid mass and are easily and safely handled. Furthermore, significant fume contaminants are not produced.

Typical depth removal in one pass is from about 3 mm to about 5 mm depending upon processing parameters.

Although the traverse speeds are relatively low at about 0.5 to about 5 mm/s, the rate of concrete volume removal is relatively high at between about 200 and about 400 $cm^3$/hr kW.

It has also been found that the second and third aspects of the present invention may be applied not only to concrete but also to other hydraulically bonded materials including mortar, plaster, rendering and stone such as sandstone, for example. Of course, these materials may also be evaporated with a suitably high laser power density.

The method according to the first aspect of the present invention may also be applied to other non-metallic materials not having a hydraulically bonded structure such as brick, other fired clay materials and ceramics for example.

In order that the present invention may be more fully understood, examples will now be given by way of illustration only with reference to the accompanying drawings, of which:

BRIEF DESCRIPTION OF THE DRAWINGS

Referring now to FIG. 1 and where a contaminated concrete substrate is denoted generally at 10. The substrate includes a surface layer 12 containing contaminants (not shown). A laser beam 14 is scanned across the surface in raster fashion to cover the area thereof. The concrete surface layer 12 is evaporated by the laser beam 14, the contaminated fume being collected by suitable extraction equipment, indicated generally at 16. A partially glazed surface layer 18 remains after the laser beam 14 has passed.

FIG. 2 shows a schematic representation of the second aspect of the method according to the present invention. A contaminated concrete substrate is shown generally at 20. The substrate has a surface layer 22 containing contaminants (not shown). A laser beam 24 is scanned across the surface in raster fashion. The traverse speed and power density are such that at a desired depth below the surface 26, the temperature exceeds 200° C. causing dehydration of the concrete and the consequent generation of water vapour and expanding air. The effect of this is to cause flakes of contaminated material 28 of the surface layer 22 to fly off as the laser beam 24 traverses. The flakes of material 28 are trapped by an extractor, shown schematically at 30, having been made to move towards the extractor 30 by a compressed air jet 32. The resulting surface 34 of the substrate 20 is rough but clean and appears to be unaffected by the laser beam.

Referring now to FIGS. 3A, 3B, 3C and 3D and where a contaminated concrete substrate is shown at 40. The substrate 40 has a surface layer 42 containing contaminants (not shown). A first coating layer 44 of a cementitious material comprising a mixture of chamotte, pozzolanna, water glass and cement is sprayed by a spraying head 46 onto the surface 48 of the substrate 40 (FIG. 3A). Once the coating 44 has been dried, a laser beam 50 is traversed across the whole surface area in raster fashion. The laser beam causes the first coating material and the upper region 52 of the contaminated surface layer 42 to form a vitreous glazed layer, the glazed coating 44 and glazed region 52 being bonded to each other and sealing any contaminants adjacent the surface 48 therein. In addition to forming the glazed layer, there is also generated a HAZ 54 below the glazed layer, the HAZ having a region therein which has been subjected to a temperature of between about 800° and about 900° C. (FIG. 3B). Once the whole surface has been scanned by the laser, a second coating 56 is sprayed onto the surface by a spray device 58. The second coating 56 may be any suitable material such as epoxy resin, water glass or cement, for example. The second coating 56 is then cured or dried as appropriate and serves the purpose of fixing any contaminants which have been deposited onto the surface 60 of the glazed layer and also to lend mechanical strength to the detached surface layer 62, which has sheared at 64 through the HAZ 54, to bond it all together (FIG. 3C). The complete bonded but detached contaminated surface layer 62 is then cut up into conveniently sized sections by a laser 66 to enable removal means to lift off each section for disposal. In this case the removal means are shown as a vacuum gripper 68 to which a vacuum 70 is applied (FIG. 3D) .

Figure 1:
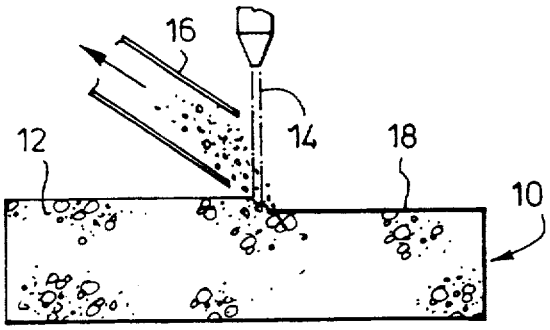
FIG. 1 shows a schematic representation according to the first aspect of the method of the present invention.
Figure 2:
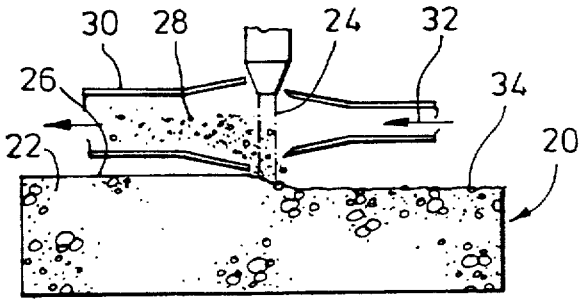
FIG. 2 shows a schematic representation according to the second aspect of the method of the present invention.
Figure 3A:
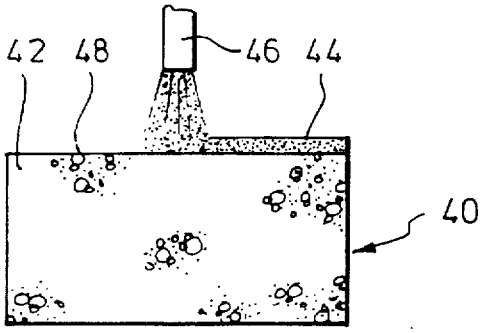
FIGS. 3A, 3B, 3C and 3D which show a schematic representation of a method according to the third aspect of the method of the present invention.
Figure 3B:
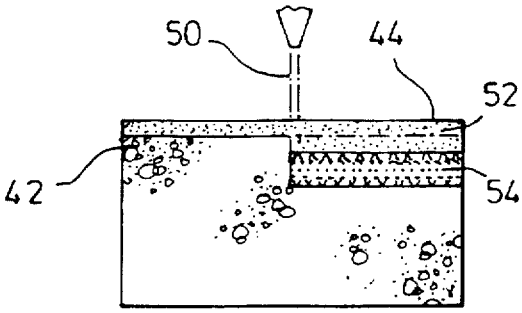
Figure 3C:
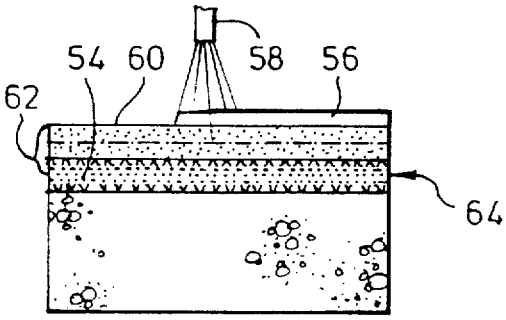
Figure 3D:
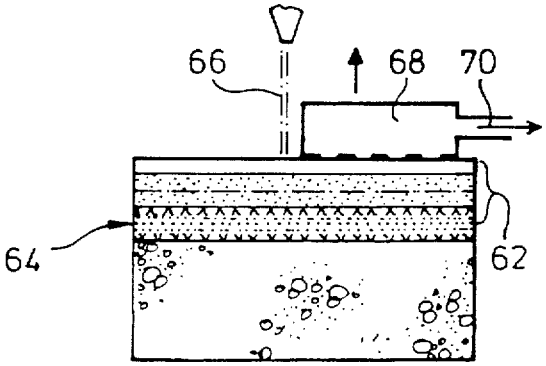

Suitable lasers include a 2 kW Electrox (trade mark) carbon dioxide laser and a 400 W Lumonics (trade mark) Neodymium-YAG laser. Other types of lasers such as semiconductor lasers, CO lasers, dye lasers and any others which have suitable power density characteristics may also be used.

An important advantage of the present invention in all of its aspects is that the contaminated surface may be treated remotely by the laser beam. Thus, people tasked with decontamination of a structure or body may be sited at a safe distance from the contamination.

Although the present invention has been described with particular reference to the decontamination of surfaces contaminated with radionuclides, it is equally well suited to the decontamination of surfaces contaminated with other contaminants such as toxic and/or heavy metal ions for example.

We claim:

1. A method for the removal of at least one contaminated surface layer from a hydraulically bonded material body, the method comprising:

providing a body comprising hydraulically bonded material and at least one contaminated surface layer to be removed;

producing relative mutual movement between the at least one contaminated surface Layer to be removed and a laser heat source such that the at least one contaminated surface layer is caused to be detached from said body due to dehydration of said hydraulically bonded material.

2. A method according to claim 1 wherein said hydraulically bonded material is concrete.

3. A method according to claim 2 wherein the at least one contaminated surface layer is caused to be detached from said body by generating thermal stresses in or below the at least one contaminated surface layer by generating moisture vapor through dehydration of said concrete, causing fracture of the concrete and flaking off of said at least one contaminated surface layer to form flakes.

4. A method according to claim 3 wherein a temperature of at least 200° C. is generated in or below said at least one contaminated surface layer.

5. A method according to claim 3 wherein the flakes are collected for disposal.

6. A method according to claim 3 wherein the laser heat source has a laser power density of about 100 $W/cm^2$ to about 800 $W/cm^2$.

7. A method according to claim 6 wherein the laser power density is about 300 $W/cm^2$ to about 800 $W/cm^2$.

8. A method according to claim 3 wherein the relative mutual movement between the at least one contaminated surface layer and the laser heat source is sufficient to provide a laser beam traverse speed of about 30 mm/min to about 300 mm/min.

9. A method according to claim 3 wherein the at least one contaminated surface layer is caused to be detached from said body at a rate of about 500 $cm^3/hr$ to about 800 $cm^3/hr$.

10. A method according to claim 3 wherein the at least one contaminated surface layer is caused to be detached from said body to a depth of about 1 mm to about 4 mm.

11. A method according to claim 1 wherein the at least one contaminated surface layer is caused to be detached from the body by heating with the laser heat source to produce a heat affected zone (HAZ) in the body in or below the at least one contaminated surface layer thereof, at least part of said HAZ having been subjected to a temperature range of between about 550° and about 900° C.

12. A method according to claim 11 wherein detachment occurs in the HAZ which has been subjected to a temperature range from about 800° C. to about 900° C.

13. A method according to claim 11 wherein a first coating layer of a cementitious or refractory material is applied to the at least one contaminated surface layer of the body before treatment with the laser heat source.

14. A method according to claim 13 wherein said first coating layer has a thickness of not more than about 1 mm.

15. A method according to claim 13 wherein said first coating layer comprises a mixture of chamotte, pozzolanna, water glass and cement.

16. A method according to claim 13 wherein the first coating layer is applied by spraying.

17. A method according to claim 13 wherein the first coating layer and at least a part of said at least one contaminated surface layer are glazed by said laser treatment.

18. A method according to claim 11 wherein the laser heat source has a minimum laser power density of 150 $W/cm^2$.

19. A method according to claim 11 wherein the relative mutual movement between the at least one contaminated surface layer and the laser heat source is sufficient to provide a laser beam traverse speed of about 0.5 to about 5 mm/s.

20. A method according to claim 13 wherein a second coating layer is applied to the at least one contaminated surface layer after treatment with the laser heat source.

21. A method according to claim 20 wherein the second coating layer comprises at least one material selected from the group consisting of plastics material resins, cement, mixtures including cement, refractory materials, and water glass.

22. A method according to claim 20 further comprising cutting into sections said at least one contaminated surface layer after treatment with the laser heat source and detachment from said body.

23. A method according to claim 22 wherein said sections are removed as solid sheets.

* * * * *